US006837090B2

(12) United States Patent
Svejkovsky

(10) Patent No.: US 6,837,090 B2
(45) Date of Patent: Jan. 4, 2005

(54) ROLLING LINE FOR THE CONTINUOUS ROLLING OF STRAND-SHAPED PRODUCTS

(75) Inventor: Ulrich Svejkovsky, Wuppertal (DE)

(73) Assignee: SMS Meer GmbH, Monchengladbach (DE)

( * ) Notice: Subject to any disclaimer, the term of this patent is extended or adjusted under 35 U.S.C. 154(b) by 212 days.

(21) Appl. No.: 10/337,940

(22) Filed: Jan. 7, 2003

(65) Prior Publication Data

US 2003/0154758 A1 Aug. 21, 2003

(30) Foreign Application Priority Data

Jan. 9, 2002 (DE) ..... 102 00 442

(51) Int. Cl.[7] ..... B21B 31/10

(52) U.S. Cl. ..... 72/226; 72/239

(58) Field of Search ..... 72/226, 234, 239

(56) References Cited

U.S. PATENT DOCUMENTS 3,396,566 A * 8/1968 Alsop et al. ..... 72/239
4,406,145 A * 9/1983 Akita ..... 72/239

FOREIGN PATENT DOCUMENTS

DE 33 17 748 11/1983

* cited by examiner

*Primary Examiner*—Lowell A. Larson
(74) *Attorney, Agent, or Firm*—Herbert Dubno

(57) ABSTRACT

A rolling train for the continuous rolling of strand shaped products has at each rolling location a pair of fixed stations which are closely spaced and have rails such that a mill stand at one station can be displaced away from the rolling line and be replaced at that location by a mill stand at the other station. The mill stands can be connected to the respective control and operating media sources by lines which are unreeled as the mill stand is moved away from the operating position or reeled up as the mill stand is moved into an operating position.

11 Claims, 2 Drawing Sheets

ROLLING LINE FOR THE CONTINUOUS ROLLING OF STRAND-SHAPED PRODUCTS

FIELD OF THE INVENTION

My present invention relates to a rolling line for the continuous rolling of strand-shaped products and, more particularly, to a rolling line having a plurality of rolling mill stands adapted to be positioned at fixed locations along this line and spaced apart from one another. The invention especially relates to a rolling line of this type for the continuous rolling of a product whereby the stands can be replaced or interchanged.

BACKGROUND OF THE INVENTION

Rolling lines with mill stands which are located at fixed locations along the mill line but can be replaced or exchanged are utilized in the continuous rolling of strand-shaped workpieces, like rod and wire, have been provided heretofore for the rolling of semimanufactured workpieces, i.e. workpieces which require finished rolling or other modifications to be turned into finished products, for rod, bar steel, for rod-shaped or bar-shaped structural shapes or sections for wire. They can be operated more or less continuously and the line can be a straight line or provided with diverters or the like which can loop the workpiece, divert the workpiece between branches of the line or otherwise modify the path of the workpiece through the mill stands or rolls. For a dimension change, the stands may be shifted out of the fixed position along the line and replaced in their position by another stand, previously formed for this purpose and set to the dimensions of the new product.

For the back and forth displacement of the mill stand into and out of position, additional units are required and there have been a number of proposals for achieving that result. In DE 33 17 748, for example, there are vertical and horizontal mills disposed alternately and in succession along the rolling lien and rolled product guides between the rolls of neighboring mill stands. The replacement of a roll set is achieved by shifting the entire mill group on a holding frame out of the roll line into a replacement position and then each mill frame out of the replacement position relative to the holder frame by means of a drive transverse to the roll line. The mill stands are then disposed laterally of these roll positions. The vertical frames are mounted on the holder frames in the shifting device so as to be displaceable transverse to the rolling line. For each mill in the roll replacement position a turntable is provided as well as a carriage which is displaceable at an inclination to the shifting direction. Apart from this expensive approach to the roll replacement devices, it is not possible with present day units to effect a roll replacement in very short times as is desirable.

In another proposal the mill rolls are replaced in cassettes via guide rails and actuators which operate transversely to the rolling line. These systems require the withdrawal of the roll that was previously used before it can be replaced by the roll set in readiness so that the time required for the roll replacement is significant.

OBJECTS OF THE INVENTION

It is, therefore, the principal object of the present invention to provide a rolling line and especially a rolling train for the continuous rolling of strand-shaped products, whereby the drawbacks of earlier systems can be avoided.

More specifically it is an object of the invention to provide a rolling train which enables replacement of roll sets or mills at respective rolling locations with substantially reduced downtime of the rolling train and has simple equipment.

It is also an object of the invention to shorten the time required for a roll change, and particularly for the replacement of a mill stand in a rolling train.

SUMMARY OF THE INVENTION

These objects are achieved, in accordance with the invention by providing in the rolling train for each mill stand location two fixed stations or places which lie closely proximal to one another in the rolling direction and so that a corresponding mill stand can be located at each of these stands. The stands are each provided with supply units for the fluid media and have couplings for the roll drive and for the control and operating media of the mill stand. Preferably the control and operating media for the mill stand are conducted by a flexible connecting line during the movement of the mill stand toward and away from the specific stations and the line is paid out and rolled up on a reel arrangement.

The connecting line can, according to the invention, be supported by a link chain which can be guided above the path of the mill stand or in an underfloor guide channel. The unoccupied place or station can be bridged by a swingable channel or tube through which the workpiece can be guided when the mill stand has been shifted out of its station.

More particularly, a rolling train for continuous rolling of strand-shaped products can comprise:

a plurality of mill stands disposed along a rolling line at respective locations fixed with respect to the line and spaced apart along the line, whereby a workpiece is continuously rolled in succession by rolls of the mill stand as the workpiece is passed along the line, each of the locations comprising two stations located close together and one after the other along the line in a rolling direction and adapted selectively to receive a mill stand for rolling at the respective location;

a respective control and operating media source fixed at the line for each of the stations;

respective guides forming paths extending transversely to the line away from the stations, whereby a mill stand located at one of the locations is displaceable along the respective guide away from the respective station while a corresponding replacement mill stand is displaceable toward the other station at the respective location; and connecting lines for connecting the respective sources with the respective mill stands during movement of the stands toward and away from the respective stations.

The rolling train of the invention and its operation as desired afford a significant time saving for the replacement of the mill since the replacement mill can be positioned at its station immediately upon removal of the withdrawn mill and without waiting until the withdrawn mill clears its station. The down time of the line is thus minimized. The delays in reconnection are also minimal since the fluid line can remain connected as the replacement mill is brought into position and the removed mill is shifted away and thus the time hitherto required for such weak connections is eliminated. The system also has the advantage that the replacement of the mill stand is carried out more cleanly.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
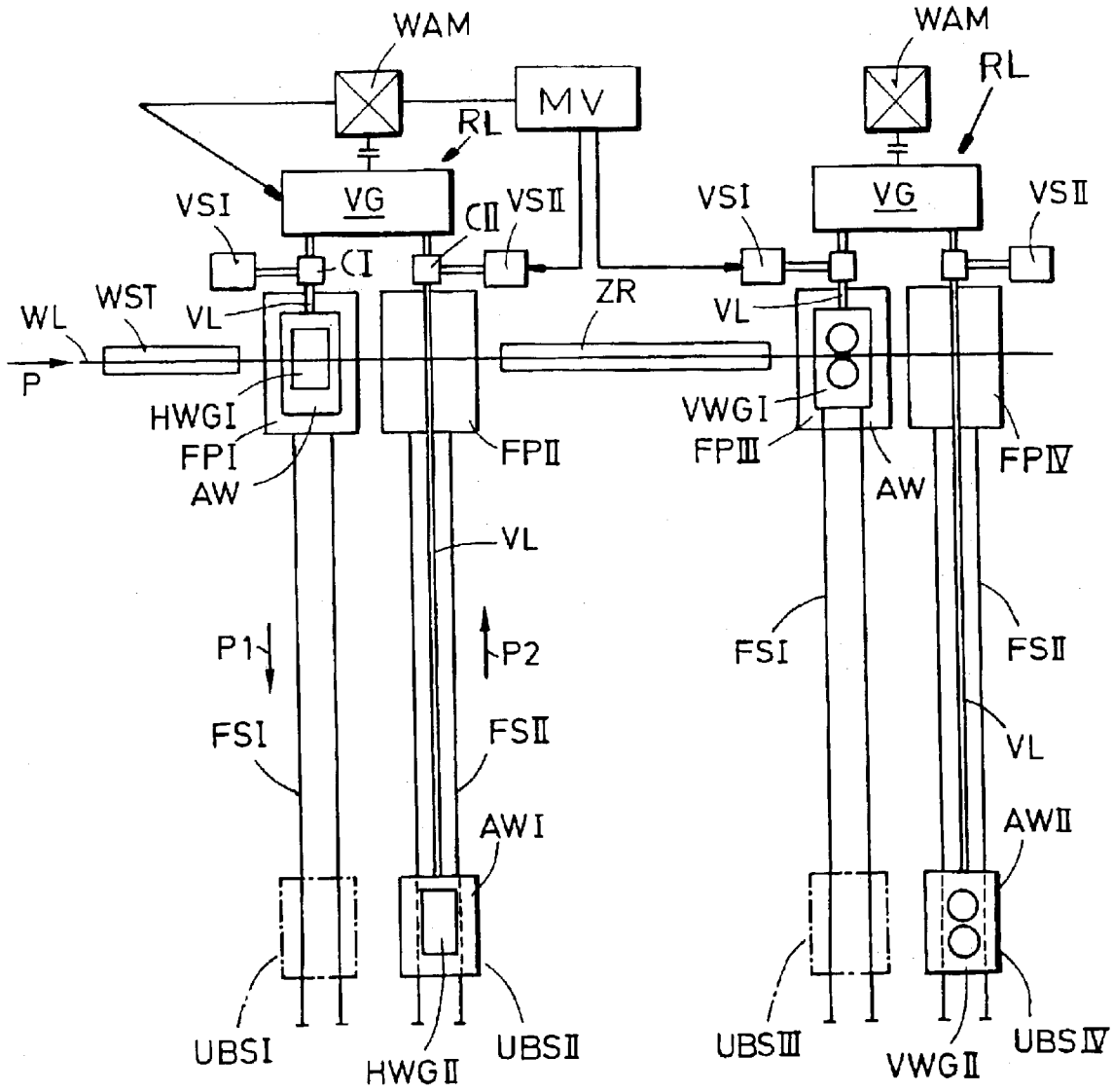
FIG. 1 is a diagram, essentially in the form of a plan view, showing a portion of a rolling mill line for strand-shaped products.

As can be seen generally from FIG. 1, in a rolling train comprised of multiple roll stands in which a continuous strand, for example, bar, wire, rod or structural shapes or sections, is successively rolled to a final shape and size, there are a number of roll locations RL along the line WL which represents the path of the strand in the rolling direction P.

At each of these rolling locations, at a short distance from one another in the direction of the arrow P and thus successively reached by the strand, are two fixed stations or places FPI and FPII at which roll stands can be positioned. Each of these fixed stations is associated with a supply station VSI or VSII for the fluid media which operate the specific mill.

Each of the mill stands is provided with a coupling unit CI or CII which serves to couple the particular mill with the supply station VSI or VSII and to a common drive VG.

Figure 2:
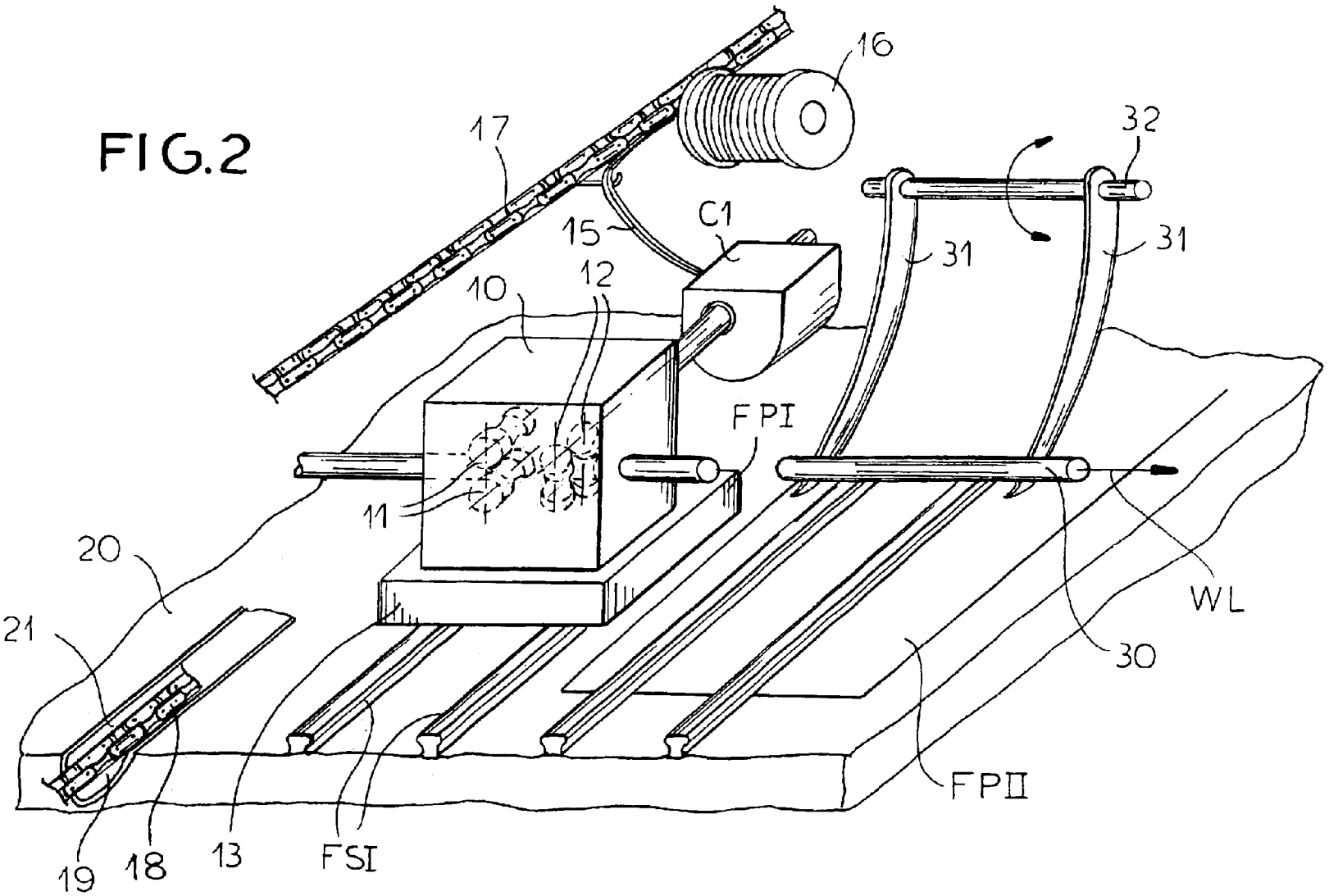
FIG. 2 is a perspective view diagramming features of the system of FIG. 1.

As will be shown in somewhat greater detail in FIG. 2, the fluid supply or surface stations VSI and VSII can be connected by supply lines VL which are connectable to the mill stand and can be rolled off or rolled onto respective reels and thus can be paid out as the mill stand is shifted away from its station FPI or FPII. The coupling members CI and CII can also provide the shaft coupling for driving the rolls of the respective mill and can drive that drive from a distributor transmission VG driven by a common motor WAM. The control and operating fluid medium for the two supply stations VSI and VSII may derive from a medium distributor MV.

Extending from the two stations FPI and FPII, transverse to the rolling line WL are guide rails FSI and FSII to stations at which the mill stands are prepared, repaired or held in readiness for a dimension change, shape change or product change.

Along the rolling line between locations RL and thus between the second station FPII of one location and the first station FPIII of the second station, a support can be provided for the workpiece in the form of an intervening roller conveyer ZR, a guide tube or an intermediate channel. The intermediate member ZR can also represent a loop former or diverter.

Referring to FIG. 2, it can be seen that a mill stand 10 which can have two or more groups 11 and 12 of rolls (in this case a pair of horizontal rolls and a pair of vertical rolls), can be provided on a carriage 13 which is displaceable on the rails FSI, FSII and has its coupling unit CI as shown in FIG. 1. The connecting lines 15 for connecting the control and operating media source to the mill stand 10 runs from a reel 16 which can pay out and take up these lines which can be supported above the path of the carriage 13 on a chain 17 suspended above the path or on a chain 18 guided in a channel 19 below the floor 20 and opening at the slot 21 in the floor.

When the mill stand is not at its station FPI or FPII, a swingable channel, tube or the like at 30 can be positioned along the rolling line WL as a guide for the workpiece across the unoccupied station.

Flappable channels and light guides may also serve for this purpose. The guide can be carried on arms 31 having a pivot 32 (FIG. 2).

The operation of replacing a mill stand at the particular rolling location is carried out as follows.

In the illustrated embodiment of FIG. 1, it is assumed that a horizontal roll stand HWGI is presently at the station FPI and is mounted on a carriage AW. After release of the coupling between the motor WAM or the distributor transmission VG and this carriage, the latter is displaced in the direction of arrow PI on the rails FSI to the rebuilding or readiness station UBSI in which its position has been shown only in dot dash lines.

The connection of the horizontal roll stand HWGI with the source VSI is maintained as the connecting line rolls off its reel. During this transport movement, the replacement horizontal roll mill HWG II, which has previously been prepared in station UBS II, is connected to the unwound line from source VSII and is shifted in the direction of arrow P2 while the connecting line is reeled up to the station FPII where its coupling is reconnected to the motor WAM or to the distributor transmission VG. Corresponding replacements are effected when required at the other rolling locations RL for the vertical mills VWGI and VWGII at the stations FPIII and FPIV.

I claim:

1. A rolling train for continuous rolling of strand-shaped products, said rolling line comprising:

a plurality of mill stands disposed along a rolling line at respective locations fixed with respect to the line and spaced apart along the line, whereby a workpiece is continuously rolled in succession by rolls of said mill stand as said workpiece is passed along said line, each of said locations comprising two stations located close together and one after the other along said line in a rolling direction and adapted selectively to receive a mill stand for rolling at the respective location;

a respective control and operating media source fixed at said line for each of said stations;

respective guides forming paths extending transversely to said line away from said stations, whereby a mill stand located at one of said locations is displaceable along the respective guide away from the respective station while a corresponding replacement mill stand is displaceable toward the other station at the respective location; and connecting lines for connecting the respective sources with the respective mill stands during movement of said stands toward and away from the respective stations.

2. The rolling train defined in claim 1 wherein a respective drive is provided at each of said stations for the respective mill stand and each mill stand is provided with a coupling unit connectable with the respective drive when positioned at said station and connected to the respective source.

3. The rolling train defined in claim 1 wherein said lines are flexible lines.

4. The rolling train defined in claim 3 wherein each of said lines is provided with a reel for rolling up and feeding out the respective lines.

5. The rolling train defined in claim 4, further comprising a support link chain for carrying the respective line along the respective path.

6. The rolling train defined in claim 5 wherein said chain is guided in a below-floor guide channel.

7. The rolling train defined in claim 5 wherein said chain is guided above the path.

8. The rolling train defined in claim 1, further comprising a workpiece guide shiftable into position along said line at a station vacated by a mill stand to guide said workpiece to a next mill stand along said line.

9. The rolling train defined in claim 8 wherein said workpiece guide is a channel or tube swingable into position at the station vacated by the mill stand.

10. The rolling train defined in claim 2 wherein the drives at each location are operated by a common motor.

11. The rolling train defined in claim 1 wherein each of said stands is provided with a plurality of pairs of mill rolls as a group stand.

* * * * *